US005746247A

United States Patent [19]

Schlecht et al.

[11] Patent Number: 5,746,247

[45] Date of Patent: May 5, 1998

[54] SLIDE VALVE FOR A TWIN-CYLINDER PUMP FOR VISCOUS FLUIDS

[75] Inventors: Karl Schlecht, Filderstadt; Hellmut Hurr, Reutlingen, both of Germany

[73] Assignee: Putzmeister-Werk Maschinenfabrik GmbH, Aichtal, Germany

[21] Appl. No.: 648,106

[22] PCT Filed: Sep. 29, 1994

[86] PCT No.: PCT/EP94/03250

§ 371 Date: May 16, 1996

§ 102(e) Date: May 16, 1996

[87] PCT Pub. No.: WO95/18304

PCT Pub. Date: Jul. 6, 1995

[30] Foreign Application Priority Data

Dec. 24, 1993 [DE] Germany ..... 43 44 632.9

[51] Int. Cl.[6] ..... F04B 7/02

[52] U.S. Cl. ..... 137/625.45; 137/874

[58] Field of Search ..... 137/874, 625.44, 137/625.45; 417/900

[56] References Cited

U.S. PATENT DOCUMENTS

| | | | |
|---|---|---|---|
| 4,502,851 | 3/1985 | Calvin et al. . | |
| 4,653,990 | 3/1987 | Schlecht | 137/625.45 X |
| 4,681,022 | 7/1987 | Schwing | 137/625.45 X |

FOREIGN PATENT DOCUMENTS

| | | |
|---|---|---|
| 2 162 406 | 6/1973 | Germany . |
| 26 14 895 | 10/1977 | Germany . |
| 26 38 162 | 11/1977 | Germany . |
| 29 09 256 | 9/1980 | Germany . |
| 32 07 160 | 9/1983 | Germany . |
| 39 05 366 | 8/1990 | Germany . |
| 41 20 466 | 1/1992 | Germany . |
| 63-176674 | 7/1988 | Japan . |

*Primary Examiner*—John Fox

*Attorney, Agent, or Firm*—Flynn, Thiel, Boutell & Tanis, P.C.

[57] ABSTRACT

The invention concerns a slide valve for a two-cylinder pump, in particular a truck-mounted concrete pump. The slide valve has an essentially C-shaped swing pipe which is connected at the upper end by a rotating joint to a discharge line and is mounted so that it can be rotated by a switchover mechanism about an axis which is essentially parallel to the axes of the pump cylinders in such a way that its lower end, which is fitted with a wearing ring, is connected alternately to the apertures at the ends of the pump cylinders connected to the rear wall of a feed tank. In order to enable the swing pipe to swing through a large distance, the swing drive cylinders, which are preferably designed as piston/cylinder units, are mounted in ball sockets located at the cylinder bearings and their axes of operation include between then an obtuse angle facing the rear wall. In addition, the valve is fitted with a switchover lever which has at the discharge end a support arm on which rests an extension pipe connected to the discharge end of the upper end of the swing pipe.

10 Claims, 3 Drawing Sheets

SLIDE VALVE FOR A TWIN-CYLINDER PUMP FOR VISCOUS FLUIDS

FIELD OF THE INVENTION

The invention relates to a slide valve device for a pump with two oppositely working conveying cylinders for the conveyance of thick matter supplied to the pump via a material feed container, with a pivoting pipe which is received in the material feed container and is curved in an essentially C-shaped manner and is connected at its upper end to a rigid conveying conduit via a rotary pipe connection. The pivoting pipe is arranged rotatably by a changeover mechanism about an axis that extends essentially parallel to the axes of the conveying cylinders, in such a way that its other lower end equipped with a wear ring is connected alternately to the orifices of the conveying cylinders connected to the rear wall of the material feed container and can be pressed there, by means of a pressure or tension device, against the edge of the perforations of an interposed wear plate. The changeover mechanism has a changeover lever arranged on the outside of the rear wall of the material feed container above the conveying cylinders, one end of which is rigidly connectable to the upper end of the pivoting pipe and on the other end of which two oppositely actuable drive cylinders, oriented essentially transversely to the conveying cylinders and to the conveying conduit and supported on opposite sides on bearings fixed to the conveying cylinders, are articulated with the mutually confronting ends of their pistons or piston rods.

BACKGROUND OF THE INVENTION

Slide valve devices of this type (DE-C-2,162,406), on account of their compact design, are suitable particularly for concrete pumps mounted on vehicles, in which the conveying pipe adjoining the slide housing makes a connection with the conveying mast resting on the front part of the running gear and in which the material feed container can be charged without difficulty from the rear end face of the running gear. The parts of the slide valve device which are exposed to high wear are easily accessible from the top side of the material feed container and can therefore be exchanged in a simple way. Furthermore, in a slide valve device of this type, it is known that the changeover lever is actuated by means of double-acting cylinders which, during the outward and return stroke, are loaded with pressurized oil alternately on the bottom side and on the rod side. In this case, the hydraulic cylinders are mounted on the cylinder side and on the rod side by a strap, on a bearing block of the running gear or on the changeover lever, clearance for bridging a particular wear path being provided at the bearing points. In this construction, however, it is considered a disadvantage that, on account of the high loads which occur, the points of articulation of the drive cylinders are inclined to a premature deflection, and that the wear path which can be accommodated in the region of the bearing points is relatively small, so that only relatively low wear in the wear ring and in the wear plate is permissible.

SUMMARY OF THE INVENTION

Proceeding from this, the object on which the invention is based is to provide a slide valve device of the initially specified type which can accommodate a large wear path and which can nevertheless absorb by a simple means the bending forces occurring during the changeover operation.

To achieve this object, it is proposed, according to the invention, that the drive cylinders be supported, at their bearing points located on the conveying cylinder side and at those located on the changeover lever side, in ball sockets by ball heads, that the drive cylinders form with one another in their actuating direction an obtuse angle open to the rear wall, and that the changeover lever have a supporting arm which projects on the conveying conduit side and on which an extension pipe connected on the conveying conduit side to the upper end of the pivoting pipe can be supported. By these measures, a relatively large wear path of the slide device can be accommodated, without undesirable sagging or twisting of the changeover lever occurring.

It has proved especially advantageous if the pivoting pipe and the extension pipe are connected releasibly to one another rigidly at the upper end of the pivoting pipe on a flange, while the extension pipe projecting rectilinearly beyond the flange in the direction of the conveying conduit and connected to the conveying conduit at the rotary pipe connection rests on the supporting arm.

For this purpose, the supporting arm can, with its end preferably carrying a bearing shell, be loosely supported against the extension pipe or be connected releasibly to the extension pipe.

In a further advantageous embodiment of the invention, the flange, together with the pivoting pipe and the extension pipe, is connected releasibly to a part of the changeover lever having the supporting arm, for example by two tension screws. The pivoting pipe and/or extension pipe can consequently be removed from the concrete pump with only a few manipulations, for example for maintenance purposes, without the material feed container and the changeover lever having to be demounted.

On account of the supporting arm according to the invention on the changeover lever, it is possible to design the drive cylinders as single-acting plunger cylinders, the plunger pistons of which can be loaded alternately with the pressurized medium. The advantage of the plunger cylinder is to be seen primarily in its robust construction and in the maintenance-fee operation brought about thereby.

By means of the ball heads according to the invention, it is possible to vary the obtuse angle formed between the drive cylinders according to the wear on the wear plate and/or of the wear ring within a wide range, for example between 177° and 145°, and at the same time ensure that, if only on account of the mutual angular position of the drive cylinders, a force component pressing the wear ring onto the wear plate is exerted on the pivoting pipe.

By the measures according to the invention, it is possible, in view of the large wear path which can be accommodated, to increase the service life of the wear parts if the wear ring arranged on one end of the pivoting pipe consists of a homogeneously wear-resistant cast or sintered material, preferably of a wear-resistant cast steel.

In a preferred embodiment or alternative form of construction of the invention, the wear ring and/or the wear plate consists of a porous ceramic material, preferably of oxide ceramic, the capillary pores of which are filled with a metal, preferably with a light metal, such as aluminum, as a strength-increasing binder.

BRIEF DESCRIPTION OF THE DRAWINGS

The invention is explained in more detail below by means of an exemplary embodiment represented schematically in the drawing. In this.

DETAILED DESCRIPTION

Figure 1:
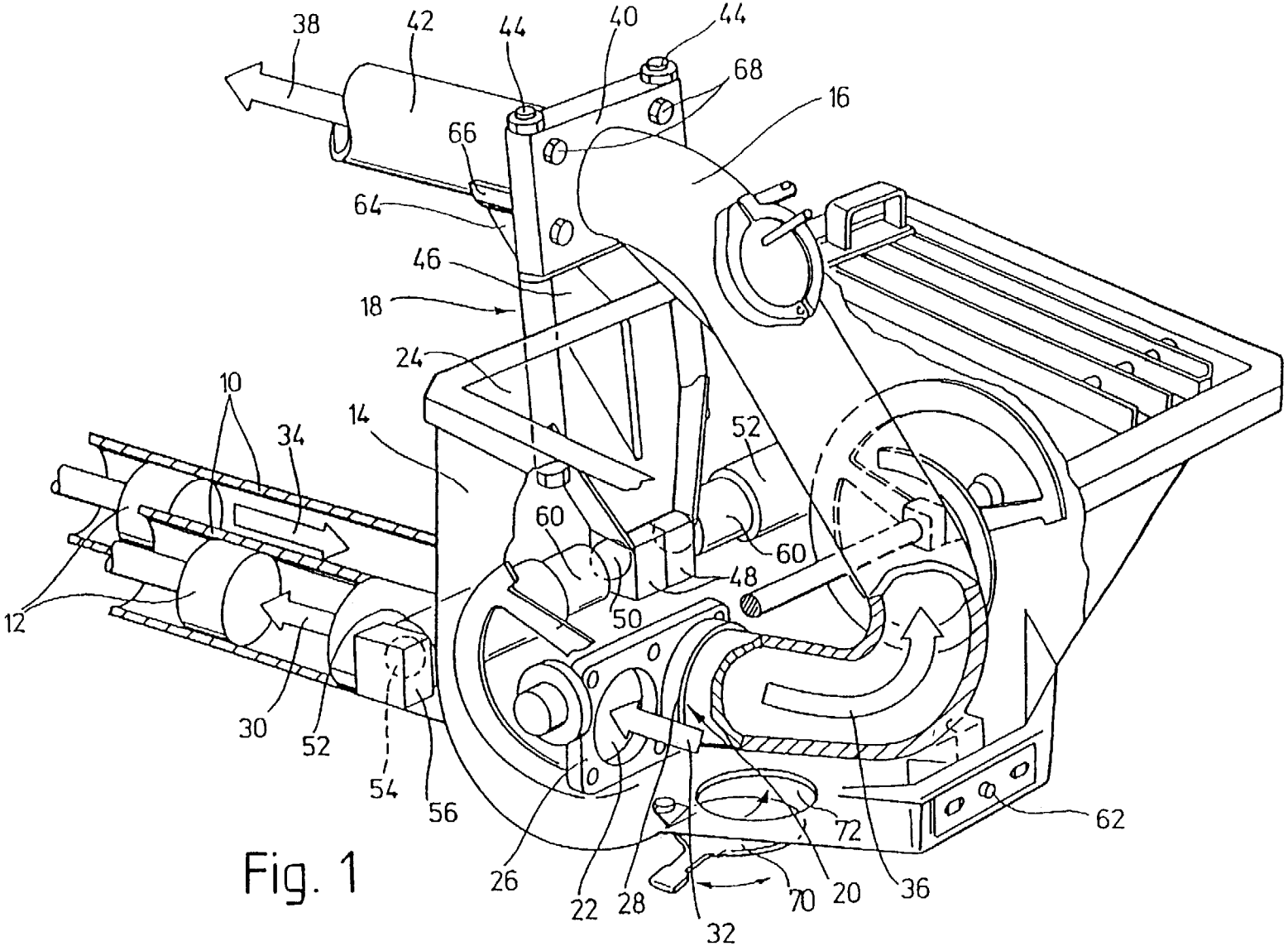
FIG. 1 shows a detail of a two-cylinder thick matter pump in a partially cut-away graphic representation.
Figure 2:
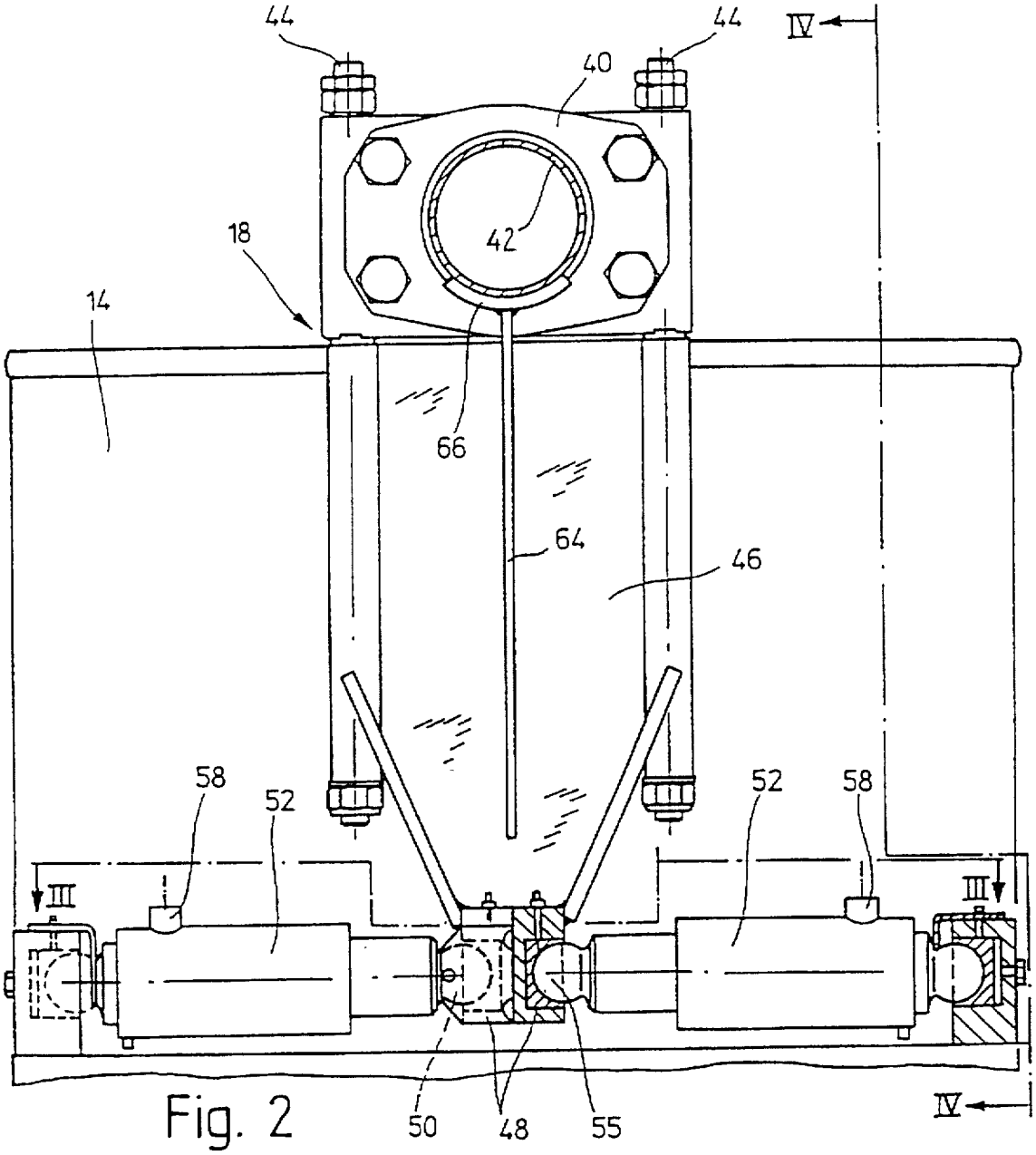
FIG. 2 shows a rear side view of the changeover mechanism of the slide valve device according to FIG. 1 in a partially sectional representation.

The two-cylinder viscous fluid pump shown in the drawing is intended for use in concrete pumps mounted on vehicles, for example on trucks.

It consists essentially of two conveying cylinders 10, with conveying pistons 12 driven hydraulically in opposition, with a material feed container 14 and a slide device 20 engaging from above with a C-shaped pivoting pipe 16 into the material feed container 14 and actuatable by a changeover mechanism 18. The conveying cylinders 10 are connected in the lower region via orifices 22 to the rear wall 24 of the material feed container 14, the orifices 22 being limited on the inside of the material feed container 14 by a spectacle-shaped wear plate 26. The pivoting pipe 16 bears with its lower end carrying a wear ring 28 against the wear plate 26 and is pivoted in front of one orifice 22 or the other by means of the changeover mechanism 18 as a function of the direction of movement of the conveying pistons 12 in the conveying cylinders 10. Thus, when the conveying piston 12 is moved back in the direction of the arrow 30, material is sucked out of the material feed container 14 in the direction of the arrow 32 through the open orifice 22 into the respective conveying cylinder 10, while, via the other conveying piston 12, material is transported in the direction of the arrows 34, 36, 38 through the pivoting pipe 16 into a conveying conduit located behind the rear wall 24 of the material feed container 14. For this purpose, the pivoting pipe 16 is connected via a flange 40 to an extension pipe 42 which is itself connected via a rotary pipe connection to a conveying conduit, for example a concrete distributor mast.

Figure 3:
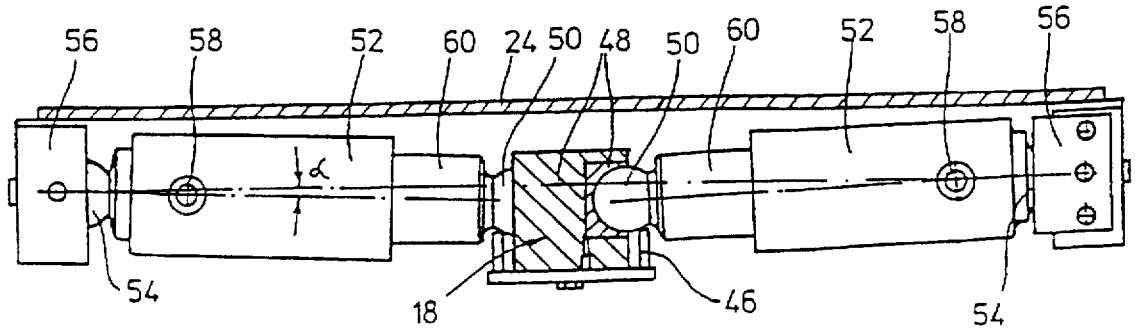
FIG. 3 shows a section along the sectional line III—III of FIG. 2.
Figure 4:
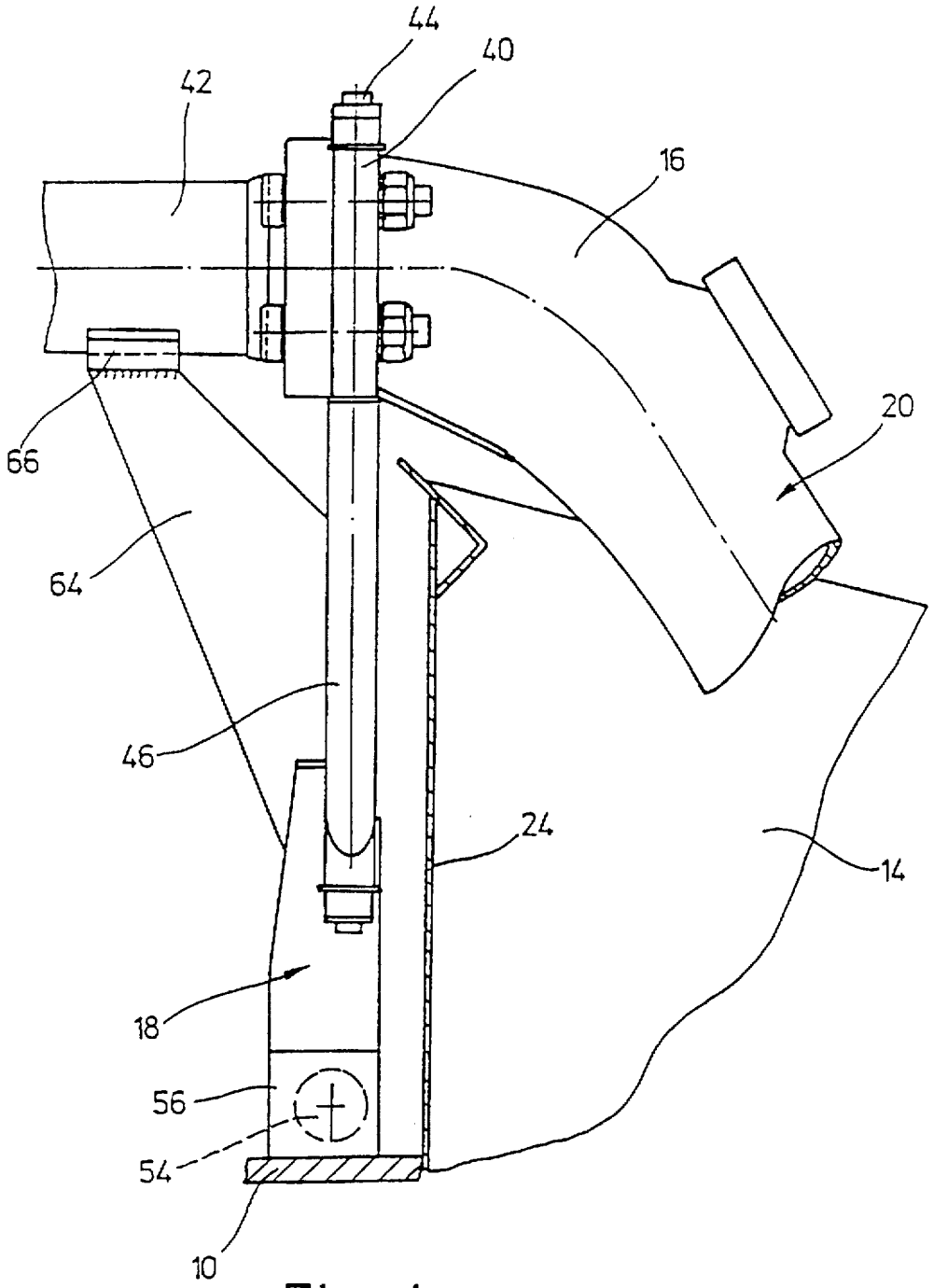
FIG. 4 shows a section along the sectional line IV—IV of FIG. 3 in a truncated representation.

The flange 40 is connected releasibly to the changeover lever 46 of the changeover mechanism 18 by two tension screws 44, the changeover lever 46 having at its lower end two bearing points 48 pointing towards opposite sides and designed as ball sockets, in each case for the connection of a piston-side ball head 50 of the two drive cylinders 52 of the changeover mechanism 18. On the cylinder side, the drive cylinders 52 are each mounted by a further ball head 54 in a bearing point 56 fixed to the conveying cylinder and designed as a ball socket. The drive cylinders 52 can be loaded with pressurized oil on one side via the connections 58 and contain a plunger piston 60 carrying the ball head 50. The drive cylinders 52 are installed in such a way that they form, in their longitudinal extension, an obtuse angle $\beta=180°-2\alpha$ open to the rear wall of the material feed container 14 (see FIG. 3), the angle a being capable of amounting to between approximately 2° and 20°, depending on the state of wear of the wear plate 26 and of the wear ring 28.

In order to ensure that the lower end of the pivoting pipe 16 presses sealingly on the wear plate 26, a pressing or tensioning force acting perpendicularly to the rear wall 24 of the material feed container 14 is exerted on the lower arm of the pivoting pipe via the setscrew 62, actuable from outside the container 14, and a corresponding thrust piece. During the pumping operation, the wear ring 28 additionally is pressed against the respective orifice edge of the wear plate 26 via hydrostatic forces within the pivoting pipe. In the course of the readjustment for wear, the changeover lever 46 travels away from the rear wall 24 in the direction of the conveying conduit.

Welded onto the conveying conduit side of the changeover lever 46 is a supporting arm 64, the upward-facing free end of which carries a bearing shell 66, in which is supported the extension pipe 42 connected to the pivoting pipe 16. The supporting arm 64 absorbs the bending moments occurring on the changeover lever 46 during the pumping and pivoting operation and transmits these to the extension pipe 42 and the pivoting pipe 16. Nevertheless, this arrangement ensures that, for maintenance purposes or in the event of wear, the extension pipe 42 and the pivoting pipe 16 can be removed in a simple way by releasing the tension screws 44 and/or the flange screws 68, without the changeover lever 46 and its supporting arm 64 having to be removed for this purpose.

Located on the underside of the material feed container 14 is an orifice 72 which can be closed by a pivoting lid 70 and via which the material feed container 14 can be completely emptied.

The following may be stated in conclusion: the invention relates to a slide valve device for two-cylinder thick matter (e.g. viscous fluid) pumps, especially for use in mobile concrete pumps. The slide valve device 20 has a pivoting pipe 16 which is curved in an essentially C-shaped manner and which is connected at its upper end to a conveying conduit via a rotary pipe connection and is arranged rotatably by a changeover mechanism 18 about an axis essentially parallel to the axes of the conveying cylinders 10, in such a way that its lower end equipped with a wear ring 28 is connected alternately to the orifices 22 of the conveying cylinders 10 connected to the rear wall of a material feed container 14. In order that a large wear path of the pivoting pipe 16 can be accommodated, the drive cylinders 52, expediently designed as plunger cylinders, are supported at their bearing points in ball sockets by ball heads and form with one another in their actuating direction an obtuse angle open to the rear wall. Provided, furthermore, is a changeover lever having on the conveying conduit side a supporting arm 64, on which an extension pipe 42 connected on the conveying conduit side to the upper end of the pivoting pipe can be supported.

The embodiments of the invention in which an exclusive property or privilege is claimed are defined as follows:

We claim:

1. A slide valve device for a viscous fluid pump comprising a material feed container, a pump having two oppositely working conveying cylinders for a conveyance of viscous fluid supplied to the pump from the material feed container, the conveying cylinders having orifices communicating through a wall of the material feed container into an interior of the material feed container, an essentially C-shaped pivoting pipe positioned in the material feed containers, a conveying conduit for transporting the viscous fluid to a desired location, a rotary pipe connection adapted to rotatably fluidly connect an upper end of the pivoting pipe to the conveying conduit, a changeover means for rotating the rotary pipe connection about an axis that extends essentially parallel to axes of the conveying cylinders, a lower end of the pivoting pipe having a wear ring fixed thereon alternately connectable to one of the orifices of the conveying cylinders in response to an operation of the changeover means, a wear plate positioned on a wall of the material feed container surrounding the orifices, a tensioning means for pressing the wear ring against the wear plate, the changeover means having a changeover lever arranged on an outside of the wall of the material feed container above the conveying cylinders, a first end of the changeover lever being rigidly connectable to the upper end of the pivoting pipe, two oppositely actuatable drive cylinders oriented generally transversely to the conveying cylinders and to the conveying conduit, the conveying cylinders having a support means for supporting the drive cylinders on opposite sides, a second end of the changeover lever being supported on the drive cylinders, the drive cylinders having pistons with mutually confronting articulated ends, the drive cylinders having supporting points connected to the support means of the conveying cylinders and located on the articulated ends, the supporting means and the second end of the changeover lever having ball sockets and the articulated ends of the drive cylinders and an end of the drive cylinders distal the articulated ends having ball heads received in the ball sockets, the drive cylinders forming with one another along the longitudinal direction thereof an obtuse angle open to the wall of the material feed container, the changeover lever having a supporting arm extending outside the material feed container, and the conveying conduit having an extension pipe connected to the upper end of the pivoting pipe, the supporting arm supporting the extension pipe.

2. The slide valve device as claimed in claim 1, wherein a flange releasibly, rigidly connects the pivoting pipe and the extension pipes, the extension pipe projecting rectilinearly beyond the flange toward the conveying conduit, and the extension pipe being connected to the conveying conduit via the rotary pipe connection.

3. The slide valve device as claimed in claim 1, wherein the supporting arm has a bearing shell loosely supporting the extension pipe.

4. The slide valve device as claimed in claim 1, wherein the supporting arm is connected releasibly to the extension pipe.

5. The slide valve device as claimed in claim 1, wherein the pivoting pipe is connected releasibly to the changeover lever.

6. The slide valve device as claimed in claim 2, wherein the flange, together with the pivoting pipe and the extension pipe, is connected releasibly to a part of the changeover lever having the supporting arm.

7. The slide valve device as claimed in claim 1, wherein the obtuse angle formed between the axes of the drive cylinders is in the range of 177° to 140° according to a state of wear of at least one of the wear plate and the wear ring.

8. The slide valve device as claimed in claim 1, wherein the wear ring arranged on the lower end of the pivoting pipe consists of homogeneously wear-resistant cast or sintered material.

9. The slide valve device as claimed in claim 1, wherein at least one of the wear ring and the wear plate consists of a porous ceramic material, the pores of which are filled with a metal.

10. The device as claimed in claim 1, wherein the single-acting drive cylinders are equipped with a plunger piston loaded alternately with a pressurized medium.

* * * * *